United States Patent [19]

Krishnamurthy

[11] 4,121,257

[45] Oct. 17, 1978

[54] CATHODE-RAY TUBE WITH DOUBLE TENSION BAND

[75] Inventor: Varahur Ramaswamy Krishnamurthy, Penetang, Canada

[73] Assignee: RCA Corporation, New York, N.Y.

[21] Appl. No.: 772,998

[22] Filed: Feb. 28, 1977

[51] Int. Cl.[2] ..... H01J 29/87

[52] U.S. Cl. ..... 358/246; 220/2.1 A

[58] Field of Search ..... 358/248, 249, 245, 246; 220/2.1 A, 2.3 A

[56] References Cited

U.S. PATENT DOCUMENTS

| | | | |
|---|---|---|---|
| 3,573,368 | 4/1971 | Kober | 358/246 |
| 3,597,537 | 8/1971 | Kubo | 358/246 |
| 3,890,464 | 6/1975 | Hill | 220/2.1 A |

*Primary Examiner*—Howard W. Britton
*Assistant Examiner*—Edward L. Coles
*Attorney, Agent, or Firm*—E. M. Whitacre; G. H. Bruestle; L. Greenspan

[57] ABSTRACT

Cathode-ray tube has, for implosion protection, a first smooth-plastic-coated (preferably acrylic- or alkyd-coated) steel band laid directly on and encircling the glass panel, and a second smooth-plastic-coated steel band on the first band. Both bands are tensed to provide hoop compression in the glass panel of the tube. In some embodiments there may be a lubricating overcoating over the plastic coating and/or a short length of tape under the seal on the first band. Also, the forward edge of the first band may lie over the mold match line or up to 0.300 inch forward of the mold match line.

10 Claims, 3 Drawing Figures

CATHODE-RAY TUBE WITH DOUBLE TENSION BAND

BACKGROUND OF THE INVENTION

This invention relates to a cathode-ray tube having an improved implosion-protection system, and particularly an improved double tension band, or double "T-band," as it is called in the art, for implosion protection.

Cathode-ray tubes comprising evacuated glass bulbs are mass-produced articles of commerce. They usually include a faceplate panel hermetically sealed to a funnel. A luminescent screen is carried on the inner surface of the panel, and one or more electron guns are housed in a neck attached to the narrow end of the funnel. Some adverse effects of implosion of the bulb can be reduced or eliminated by providing an implosion protection system around the panel.

Examples of one family of such systems, known generally as double tension band, or double "T-band," systems are described in U.S. Pat. Nos. 3,697,686 to A. Hildebrants and 3,890,464 to M. Hill et al. Prior double T-band systems comprised a plastic or fabric tape encircling the panel, a first tensed steel band on the fabric tape encircling the panel and a second tensed steel band on the first band encircling the panel. The steel bands are usually coated with a zinc or a zinc-and-epoxy coating. These prior double T-band systems provided the required degree of safety to the viewer of the tube. However, it is desirable to provide double T-band systems which are easier and cheaper to manufacture but still provide the required degree of safety to the viewer.

SUMMARY OF THE INVENTION

The novel cathode-ray tubes include a double T-band implosion-protection system comprising a first and a second steel band each of which has a smooth plastic coating, and preferably a lubricating overcoating thereon. The first steel band is laid directly on the glass panel, and the second steel band is laid on the first steel band. A short length of tape may be adhered to the panel under the seal on the first band.

By employing the smooth plastic coatings on the bands instead of the prior coatings, the tension in the bands is more easily and uniformly distributed around the panel. A lubricating overcoating further aids in this purpose. Also, the plastic coating on the bands eliminates the need for an encircling plastic or cloth tape. Thus the improved implosion-protection system requires fewer parts, is easier to assemble and is lower in cost. Nevertheless, the improved system provides the required degree of safety.

DETAILED DESCRIPTION OF THE PREFERRED EMBODIMENT

Figure 1:
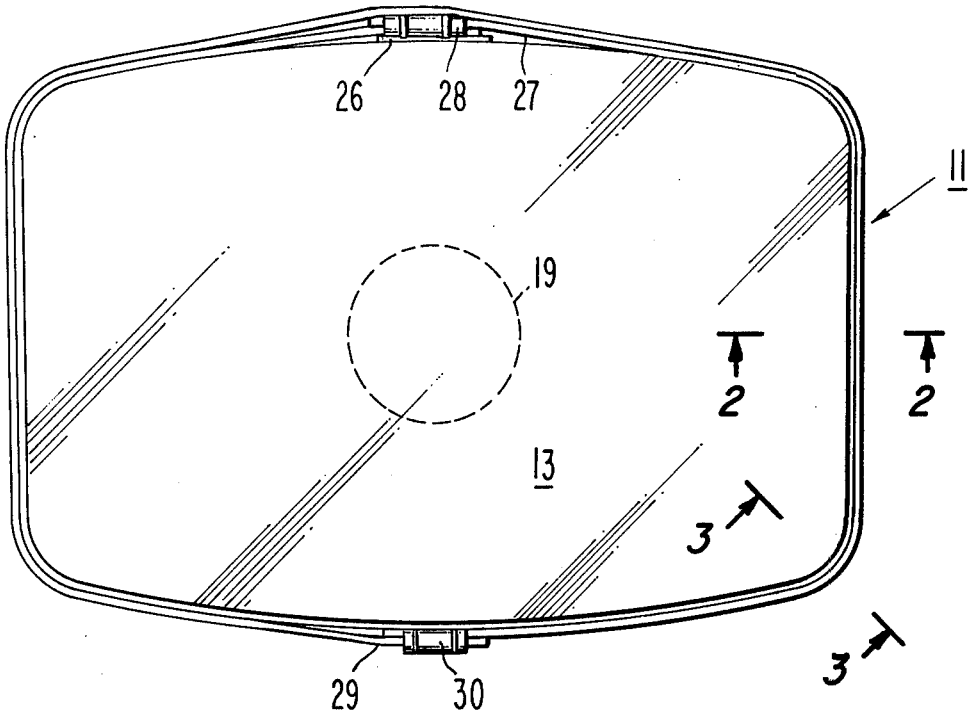
FIG. 1 is a front elevational view of a novel cathode-ray tube showing the improved implosion-prevention system encircling the tube.
Figure 2:
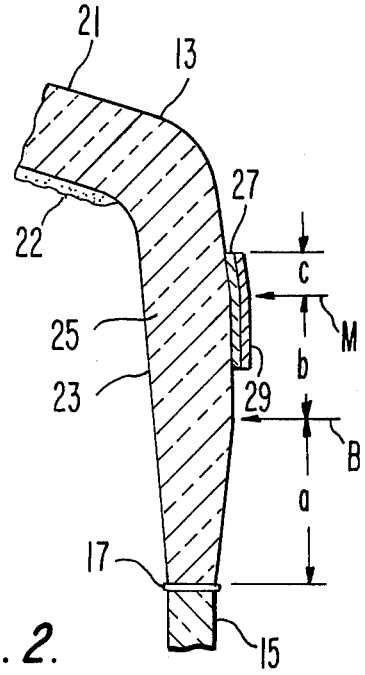
FIG. 2 is an enlarged fragmentary sectional view of the cathode-ray tube shown in FIG. 1 viewed along section lines 2—2.
Figure 3:
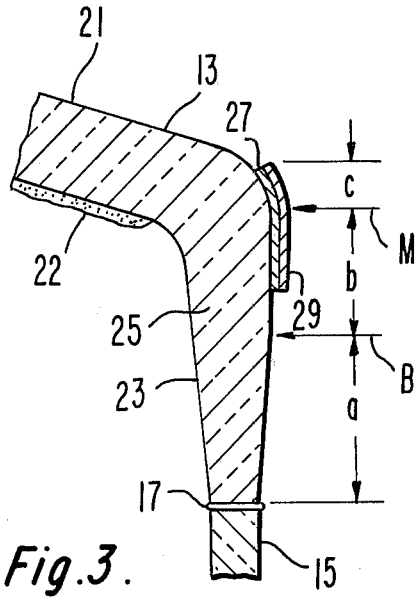
FIG. 3 is an enlarged fragmentary sectional view of the cathode-ray tube shown in FIG. 1 viewed along section lines 3—3.

FIGS. 1, 2 and 3 show a novel cathode-ray tube 11 comprising an evacuated glass envelope or bulb including a rectangular faceplate panel 13 sealed to the large end of a rectangular funnel 15 at a joint 17 and a tubular neck 19 sealed to the small end of the funnel 15. The neck houses one or more electron guns (not shown) and is closed by a glass stem (not shown) which is sealed to the extended end of the neck 19. The panel 13 may be generally rectangular in shape and comprises a generally spherically curved viewing window 21 and a continuous peripheral sidewall 23 integral with and extending back from the window. The window 21 carries on its inner surface a luminescent viewing screen 22. In this example, the panel is a commercial rectangular 25V size having an overall diagonal dimension of about 26.25 inches (666.7 mm).

The joint 17 as shown is a frit seal that is in common use on color television picture tubes. The joint 17 may be integral and fused as is in common use on monochrome picture tubes. The improved implosion-protection system described herein may be used on both color and monochrome tubes and is especially applicable to rectangular tubes, although it may also be used to advantage on round tubes.

The inner sidewall 23 may carry an apertured mask or other structure (not shown) to aid in color selection. The outer surface of the sidewall 23 includes the usual maximum outer dimension rib 25 of height *b* whose forward edge is the mold-match line left by the mold during the forming of the panel. The mold-match line is indicated by the arrow M. In the context of this description, "forward of the mold-match line" or "forward" means towards the viewer and away from the funnel 15. FIGS. 2 and 3 show that the sidewall 23 is longer along the side of the window 21 and shorter at the corners of the window 21. This is a consequence of the generally spherical shape of the window 21. As a result, the mold-match line is closer to the juncture of the sidewall 23 and the window 21 at the diagonal than along the side of the window.

Damage and injury from implosion of the cathode-ray tube 11 are reduced or eliminated by the improved implosion-protection system. The system comprises a first smooth-plastic-coated steel band 27 lying directly on and encircling said panel 13. The first steel band 27 is tensed to at least 1500 pounds (680 kg) and crimped together with a first steel seal 28. The crimp may either be outward or inward as shown in FIGS. 3 and 7 of the above-cited Hill et al patent. Unlike prior double T-band systems, it is unnecessary to provide an encircling layer of tape between the first steel band 27 and the glass sidewall 23. However, it is preferred to provide a short length of tape 26 between the first steel seal 28 and the glass sidewall 23 when a downward crimp is used. A second smooth plastic-coated steel band 29 lies on top of the first steel band 27 encircling the panel 13. The second steel band 29 is tensed to at least 1500 pounds and crimped together with a second steel seal 30. Again the crimp may be either outward or inward. The first and second seals are preferably on opposite sides of the panel 13. As shown in FIG. 1, the first seal 28 is at about the 12 o'clock position and the second seal 30 is at about the 6 o'clock position, but other positions may be chosen.

The improved implosion-protection system may be assembled on the panel 13 by the following procedure. A short length of plastic tape 26 is adhered to the outside of the sidewall 23 centered at about the 12 o'clock position. The first steel band 27 is positioned loosely around the panel 13 with the ends thereof threaded through an open first seal 28, which is positioned over the tape 26. A tensioning tool is now applied to draw up the band 27 to a tension greater than about 1500 pounds (680 kg). With the tension applied, a crimping tool is applied to the seal 28, securing together the ends of the first band 27. The second steel band 29 is now positioned loosely around the panel 13 with the end thereof threaded loosely through an open second seal 30, which is positioned on the opposite side of the panel 13 at about the 6 o'clock position. A tensioning tool is now applied to draw up the band 29 to a tension greater than about 1500 pounds (680 kg). With the tension applied to the band, a crimping tool is applied to the seal, securing together the ends of the second band 29.

While crimped metal seals are used in this embodiment as a means for securing together the ends of the first and second steel bands 27 and 29, any other means for securing together the ends of each band may be used. The first and second steel bands 27 and 29 prior to coating are about 0.750 inch (19.05 mm) wide and about 0.025 inch (0.64 mm) thick with a longitudinal breaking strength of about 2600 pounds (1179 kg). Other thicknesses and widths may be used. Each band should have a breaking strength of at least 2200 pounds (1179 kg).

The coatings on the first and second steel bands 27 and 29 must be of a plastic, such as an acrylic or alkyd polymer or copolymer, with a smooth surface. "Smooth" is a relative term and is best defined by comparisons. The smoothness required is much smoother than the surfaces of zinc and zinc-and-epoxy coatings. The smoothness required is at least that of a baked enamel paint. One suitable coating is a pigmented alkyd thermoset polymeric material that has been bake-cured to an abrasion-resistant semi-gloss finish. By providing such coatings, it has been found that the steel bands slip more easily around the corners of the panel permitting the tension applied to the bands during and after tensioning to redistribute more quickly and more uniformly than with prior steel bands. It is desirable that the plastic coatings have a thin lubricating overcoating such as a wax to further facilitate the slippage of the first and second steel bands around the panel as the tension is applied when the system is being assembled.

Slippage of a band around the corners of the panel to redistribute the tension in the band is required at several times in assembling the system. The band must slip around the corners of the panel when the band is drawn up by the tensioning tool. Parts of the tensioning tool and the crimping tool are between the band and the panel during the assembling steps. When the tools are removed, the slack in the band is taken up by the tension in the band. Again, the band must slip around the corners of the panel to equalize the tension. One family of suitable coated steel bands is marketed by the Interlake Steel Corporation in various sizes under the name Black painted, Lubric steel strapping. The matters of smoothness and slippage of the bands are related to the forces required to overcome the initial (standing) friction and the sliding friction between the first band and the glass sidewall and between the first band and the second band. In one test comparing plastic-coated bands with epoxy-and-zinc-coated bands for friction, the plastic-coated bands required about 3 pounds to overcome initial friction and about 1.5 pounds to overcome sliding friction; whereas the epoxy-and-zinc-coated bands required about 8.5 pounds to overcome initial friction and about 3.0 pounds to overcome sliding friction. This test involved dragging a 1.25-inch-wide band on a surface with a 15-pound load thereon. Generally, the bands used in the novel method require one half or less the forces required to overcome initial friction (called breakaway) and sliding friction (called slip) than is required for zinc-and-epoxy-coated bands.

The position of the steel bands on the panel is also important. Typical cross sections of the sidewall viewed through the center of the vertical size (major axis) and through the corner (diagonal axis) respectively are shown in FIGS. 2 and 3 respectively. A rib 25 of height *b* is located so that the back edge of the rib (indicated by the arrow B) is a distance a forward of the joint 17. The front edge of the rib 25 is the mold-match line M. The rib 25 is the widest part of the panel as viewed in FIG. 1. As shown in FIGS. 2 and 3, the front edge of the first and second steel bands 27 and 29 is a distance *c* in front of the mold-match line M. In the example, the distance *c* is about 0.250 inch (6.35 mm). The distance *c* may be as little as 0.000 inch (0.00 mm); that is, the front edges of the bands lie over the mold-match line M. However, more strength is imparted to the tube 11 as the value of *c* is increased. The value of *c*, however, is limited by the height of the sidewall 23 at the corners of the panel as shown in FIG. 3. Because the window 21 is generally spherical in shape, the overall height of the sidewall 23 is shorter in the corners of the panel 21 than elsewhere, although the values of *a* and *b* remain constant all around the panel. By experience, *c* has a maximum value of about 0.300 inch (7.62 mm).

Mounting lugs (not shown) may be included in the improved implosion protection system. A mounting lug is essentially an L-shaped angle bracket. One leg of a lug is located at each corner between the first and second steel bands. The lug is held in position by friction with the steel bands. In some cases, it may be desirable to employ adhesive between the lugs and the bands.

The improved implosion-protection system does not require any adhesive or any encircling tape between the bands and the glass sidewall. The system is assembled on the tube using the methods previously used for providing tension bands to a tube. The simple positioning, tensioning, and securing of the first and second steel bands at the designated location on the sidewall of the panel are all that are required. Because of the coating on the bands, the bands are grasped more securely by the tensioning tool and the bands slip more easily around the corners of the panel. The simplicity of the system results in lower costs for both labor and material resulting in lower overall cost. The lower costs, however, do not require any compromise in safety or strength as evidenced by the fact that the system exemplified above has been approved by the Underwriters Laboratories and other organizations which set safety standards for manufactured articles.

I claim:

1. A cathode-ray tube comprising an evacuated glass bulb comprising a faceplate panel joined to a funnel, said tube having an improved implosion-protection system consisting essentially of (a) a first smooth-plastic-coated steel band laid directly on and encircling said panel and tensed to provide hoop compression in said bulb, the ends of said first tension band being secured together, (b) and a second smooth-plastic-coated steel band laid directly on and encircling said first steel band and tensed to provide hoop compression in said bulb, the ends of said second tension band being secured together.

2. The cathode-ray tube defined in claim 1 including
(c) short length of tape adhered to said panel between said panel and said first steel band under that portion where the ends of said first steel band are secured together.

3. The cathode-ray tube defined in claim 1 wherein said first and second steel bands have a longitudinal breaking strength of at least 2200 pounds, and said first and second steel bands are tensed to at least 1500 pounds.

4. The cathode-ray tube defined in claim 1 wherein said plastic coating is of an acrylic or alkyd polymer or copolymer.

5. The cathode-ray tube defined in claim 1 wherein said faceplate panel includes (i) a window whose inner surface carries a luminescent screen and (ii) a peripheral sidewall integral with and extending back from said window, the outer surface of said sidewalls having a mold-match line which is the widest part of said panel and from which the surface of said sidewall slopes toward said window, said first steel band encircling said peripheral sidewall over said mold-match line.

6. The cathode-ray tube defined in claim 5 wherein said first steel band lies entirely over the sidewall surface between the mold-match line and the extended end of said sidewall with the forward edge of said first band lies substantially over said mold-match line.

7. The cathode-ray tube defined in claim 5 wherein said first steel band lies mostly over the sidewall surface between the mold-match line and the extended end of said sidewall with the forward edge of said first band lying up to 0.300 inch forward of said mold-match line.

8. The cathode-ray tube defined in claim 1 wherein said first and second steel bands each have a smooth plastic coating and a lubricating overcoating thereon.

9. The cathode-ray tube defined in claim 8 wherein said overcoating is a wax.

10. A cathode-ray tube having an improved dry implosion-protection system consisting essentially of
(a) a glass bulb comprising (i) a substantially rectangular faceplate panel including a window whose inner surface carries a luminescent screen and a continuous peripheral sidewall integral with and extending back from the window, said sidewall including a mold match line on the outer surface thereof left by the mold during the forming of said panel and (ii) a funnel whose narrower end terminates in a neck in which one or more electron guns are housed and whose wider end is sealed to the extended end of the sidewall of said panel,
(b) a first smooth plastic-coated steel tension band laid directly on and encircling said sidewalls near said window and tensed to provide hoop compression on said bulb, the ends of said tension band being crimped together on one side of said bulb,
(c) a second smooth plastic-coated steel tension band placed directly over said first band and also tensed to provide hoop compression on said bulb, the ends of said second tension band being crimped together on the opposite side of said bulb,
(c) and a short length of tape adhesively attached to said sidewall under that portion of said first steel band where the ends thereof are crimped together.

* * * * *